United States Patent [19]

Fisher

[11] 4,040,915

[45] Aug. 9, 1977

[54] METHOD FOR PRODUCING REGULAR ELECTRONICKEL OR S NICKEL ROUNDS FROM ELECTROPLATING BATHS GIVING HIGHLY STRESSED DEPOSITS

[75] Inventor: Gordon Lloyd Fisher, Mahwah, N.J.

[73] Assignee: The International Nickel Company, Inc., New York, N.Y.

[21] Appl. No.: 696,209

[22] Filed: June 15, 1976

[51] Int. Cl.[2] ..... C25D 1/10; C25D 1/20

[52] U.S. Cl. ..... 204/12; 204/281

[58] Field of Search ..... 204/281, 12, 3, 112

[56] References Cited

U.S. PATENT DOCUMENTS

| | | | |
|---|---|---|---|
| 1,163,337 | 12/1915 | Guggenheim | 204/281 |
| 2,530,842 | 11/1950 | Ruggieri | 204/5 |
| 2,773,816 | 12/1956 | Wesley et al. | 204/12 |
| 3,577,330 | 5/1971 | Knapp et al. | 204/112 |
| 3,668,081 | 6/1972 | Borner | 204/12 |

FOREIGN PATENT DOCUMENTS

| | | |
|---|---|---|
| 955,195 | 9/1974 | Canada |

OTHER PUBLICATIONS

Ency. Brit., vol. 17, p. 906, 1971 Ed.

*Primary Examiner*—T. M. Tufariello
*Attorney, Agent, or Firm*—Francis J. Mulligan, Jr.; Ewan C. MacQueen

[57] ABSTRACT

A permanent electrodeposition mandrel for use in making buttons or rounds of electrodeposited metal comprises a masked stainless steel plate having exposed islands of bare metal. Each of the islands has at least a recess in the bare metal surface at or near the perimeter of the island, the depth of the recess being about 0.12 mm to about 1.3 mm with the major dimension of the island being about 5 to about 50 times the depth of the recess and in the range of about 7 to about 50 mm. The mandrel is used in electrodeposition processes wherein thick deposits of high internal tensile stress metal are produced.

7 Claims, 3 Drawing Figures

METHOD FOR PRODUCING REGULAR ELECTRONICKEL OR S NICKEL ROUNDS FROM ELECTROPLATING BATHS GIVING HIGHLY STRESSED DEPOSITS

The present invention is concerned with permanent electrodeposition mandrels and more particularly with permanent electrodesposition mandrels useful for the production of thick buttons of metals which are highly stressed as deposited.

PROBLEM

Electrolytically formed rounds or buttons of the order of 25 millimeter (mm) in diameter and 6 mm thick of nickel are at present a conventional article of commerce used in the electroplating industry as anodes. Generally speaking, these materials are produced by electrodeposition on permanent mandrels and comprise metal which has a low internal stress as electrodeposited. If the metal deposited has a high internal stress as deposited there is a tendency for the button to exfoliate from the conventional permanent mandrel during electrodeposition or to drop-off as the mandrel is being removed from the electrodeposition bath. These tendencies significant operating difficulties in large-scale production of nickel rounds.

The conventional masked permanent mandrel having islands of metal exposed to the electrodeposition bath is not really permanent. The mask of electrical resist on the mandrel deteriorates in the electrodeposition bath and must be removed and replaced on the average after about 10 or so production cycles. Treatments of the bare metal islands the enhance adhesion of highly stressed deposits which have been proposed heretofore are either not effective at all in solving the problem of button adhesion or operate only for up to 5 or so production cycles. Thus, the best of the proposals alternative to the present invention involves refinishing of cathode mandrels about twice as often as is required to re-establish the mask of electrical resist.

PRIOR ART

Applicant is aware of U.S. Pats. Nos. 3,577,330 and 3,668,087 and Canadian Pat. No. 955,195. Each of these prior art documents discloses subject matter relative to the production of electrolytic nickel rounds or buttons. The totality of these prior art disclosures and the pragmatics of carrying them into practice is the basis for the afforestates problem.

In addition, applicant is away of U.S. Pat. No. 2,530,842 which discloses electroforming of phonograph record stampers. The disclosure of this patent while having superficial similarity to the invention claimed herein has as its object a completely different purpose than the purpose of the present invention.

OBJECTS OF THE INVENTION

It is an object of the invention to provide a novel electrodeposition mandrel for the production of rounds or buttons of highly stressed electrodeposited metal.

A further object of the present invention is to provide a novel process of electrodeposition employing the novel electrodeposition mandrel.

Other objects and advantages of the invention will become apparent in light of the drawing and the following general description.

DRAWING AND GENERAL DESCRIPTION

The drawing consists of three Figures wherein

Figure 1:
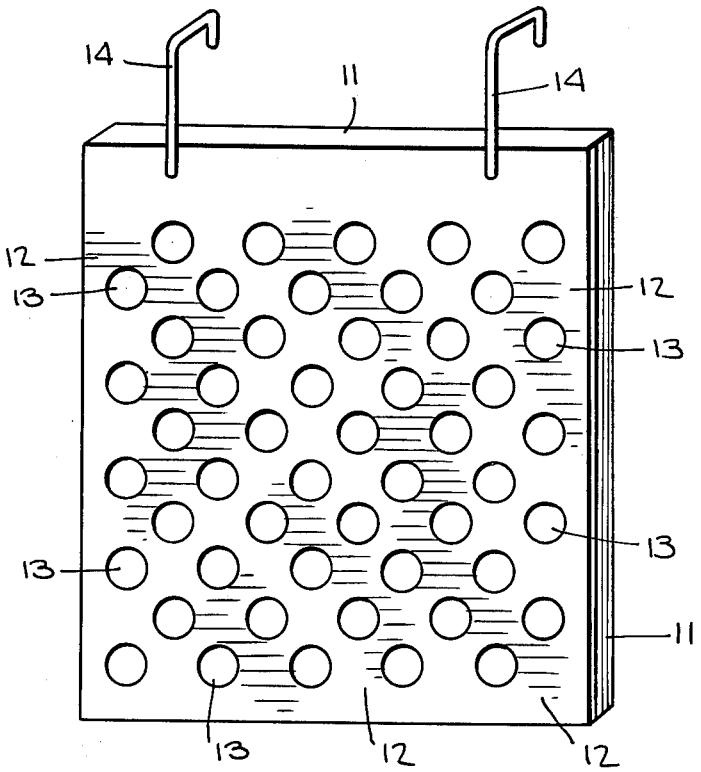
FIG. 1 is an overall view in perspective of the novel mandrel of the present invention.
Figure 2:
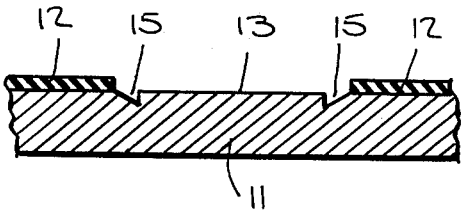
FIG. 2 is a cross-sectional view of the surface structure of an island area of the mandrel of FIG. 1.
Figure 3:
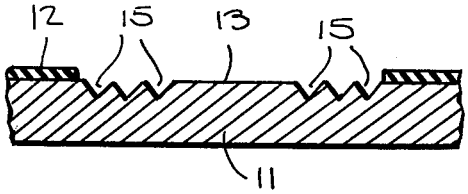
FIG. 3 is a cross-sectional view of the surface structure of different type of island area which can be used on a mandrel as depicted in FIG. 1.

Referring now the drawing, the mandrel of the present invention comprises essentially flat metal plate 11 coated with adherent mask 12 defining isolated islands 13 of bare plate metal and hanging means 14 which serve to provide contact with direct current energizing means (not shown) and to support the mandrel in an electrodeposition bath. Flat metal plate 11 is made of a metal which resists the corrosive environment of the electrodeposition bath and which forms only an ephemeral bond with electrodeposited metal. For nickel electrowinning and electrorefining baths, metals such as stainless steel (especially the austenitic varieties thereof), titanium and aluminum can usually be used. In large scale commercial use flat plate 11 is normally about 1 meter square and about 3 mm thick. Mask 12 can advantageously be an organic coating such as an epoxybased paint. Other organic-type coatings and ceramic coatings can also be used for this purpose provided that they are resistant to the effects of the electrolyte and they do not significantly conduct electricity at the voltages normally encountered in electrodeposition cells, e.g., less than 10 volts. Each of the islands 13 has a major lateral dimension of about 7 to about 50 mm. As depicted in FIG. 1 the islands are uniformly circular so that the major lateral dimension is the diameter. It will be appreciated, of course, that other shapes of islands, e.g., oval, square, rectangular, etc., can be used. As shown in FIG. 2, a groove or depression 15 is located in the surface of the base metal of plate 11 at the periphery of island 13. Groove 15 is continuous around the circumference of island 13. and must be so fashioned as to avoid undercuts which could mechanically lock electrodeposited metal to the mandrel surface. An alternate form of grooving or depressioning is depicted in FIG. 3 which comprises a series of concentric grooves or depressions 15 across a major portion of the surface of island 13. The essential groove or depression is the one at the periphery of island 13. If a continuous or essentially continuous groove is not present at the periphery, the electrodeposit formed on island 13 will tend to peel at the edges. Interiorly of the peripheral continuous groove or depression other grooves or depressions can be present in any desired configuration. For example, a product identification number or trademark can be depressed in the central portion of island 13 provided of course that no undercuts are present in the grooves or depressions.

The depth of peripheral groove or depression 15 is important. It must be in the range of about 0.12 to about 1.6 mm and the ratio of major lateral dimension of island 13 to the depth of groove 15 must be about 5 to about 50. This dimension and relationship assures that electrodeposited metal having internal tensile stresses higher than about 200 megapascals (MPa) will adhere to the mandrel during electrodeposition to thicknesses up to about 10 mm and will adhere to mandrel at the completion of electrodeposition with a force not significantly exceeding about 50 newtons (N) so that removal is facilitated. In designing a specific mandrel in accordance with the concepts expressed herein it is important that the depth of groove 15 not exceed one-half the thickness of plate 11 because resist 12 and islands 13 are normally present on both sides of plate 11. It is also, advantageous that the width of the groove at the metal surface be approximately equal to the depth of the groove.

PROCESS CONDITIONS

The mandrel of the present invention is only useful in electrodeposition processes where the metal (including alloys) deposited has an internal stress in excess of about 140 MPa tensile and is deposited for times necessary to produce deposits about 2 to about 15 mm thick. Using nickel electrodeposition as an example, it is difficult to broadly state the exact electrodeposition conditions which will result in specific internal tensile stresses because internal tensile stresses are sensitive to electrolyte impurities which may be difficult to measure or identify. Consequently, unless prior experience is available, internal stress of deposits should be measured by any one of the known methods such as described by Robert Brugger at pages 69 and 70 of the text Nickel Plating, Robert Draper Ltd. 1970.

As illustrative of the process of using the mandrel of the present invention a mandrel of stainless steel having groove patterns similar to those depicted in FIGS. 2 and 3 cut on separate circular islands bounded by an epoxy resist was employed as a cathode to produce nickel from an electrodeposition bath containing the following:

Ni $SO_4.6H_20$;135 gpl
Ni $Cl_2.6H_20$;160 gpl
$H_3$ $BO_4$;18 gpl
pH;4.0
Temperature;60° C Islands having groove pattern of FIG. 2 of the drawing were 9.52 mm in diameter with the groove depth being 1.58 mm. Islands having the groove pattern of FIG. 3 of the drawing were 31.7 mm in diameter with the groove depth again being 1.58 mm.

Nickel ws electrodeposited from the bath at a cathode current density of about 486 Amperes per square meter $A/M^2$ measured on the basis of exposed bare metal area for two periods of 6 days each with removal of the buttons after each 6-day period. At the end of this time the buttons which had an internal stress of 402 MPa tensile were adherent to the mandrel with an average adhesion force of about 18N.

A similar test was made with groove patterns die punched into the surface of islands 15.9 mm in diameter on a stainless steel mandrel. The depth of the stamped impression ranged from 0.20 mm to 0.38 mm. Nickel rounds grown for 6 days on this mandrel from a synthetic electrorefinery electrolyte had internal stresses of 303 MPa tensile. The force to remove the rounds from the mandrel was 30N.

While the foregoing tests directly demonstrate the utility of the present invention with respect to nickel electrodeposition, the mandrel of the invention is also useful with any electrodepositable metal which deposits in a form which is highly stressed internally. Such metals include cobalt, iron, chromium, and alloy deposits of nickel-cobalt and nickel-iron.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A permanent reuseable mandrel for electrodeposition of discrete electrodeposits of metal having a high internal stress as deposited comprising and essentially flat plate of metal resistant to the corrosive environment of a metal electrodeposition bath and adapted to be suspended in such a bath in contact as a cathode with an electrical energizing means, said flat plate being masked with an adherent electrical resist to define islands of bare metal on the surface of said plate, each of said islands having a major lateral dimension of about 7 to about 50 mm and having a continuous non-undercut recess in the bare metal surface thereof adjacent to and parallel to the perimeter of each of said islands, said recess being about 0.12 mm to about 1.6 mm in depth with the ratio of lateral dimension to depth of recess being about 5 to 50.

2. A reusable mandrel as in claim 1 wherein the islands are circular and the surface of each island contains additional recesses interior of said recess adjacent to and parallel to the perimeter of each of said islands.

3. A reuseable mandrel as in claim 2 wherein the additional recesses comprise a plurality of recesses interior of and concentric to said recess adjacent to and parallel to the perimeter of each of said islands.

4. A reuseable mandrel as in claim 1 wherein the recess is cut into the bare metal surface.

5. A reuseable mandrel as in claim 1 wherein the recess is punched into the bare metal surface.

6. In a process of electrodeposition of metal having an internal stress of at least about 140 MPa tensile having an internal stress of at least about 140 MPa tensile carried on for times necessary to produce deposits about 2 to about 15 mm thick, the improvement comprising employing as a cathode in said process a permanent reuseable mandrel comprising an essentially flat plate of metal resistant to the corrosive environment of a metal electrodeposition bath and adapted to be suspended in such a bath in contact as a cathode with an electrical energizing means, said flat plate being masked with an adherent electrical resist to define islands of bare metal on the surface of said plate, each of said islands having a major lateral dimension of about 7 to about 50 mm and having a continuous non-undercut recess in the bare metal surface thereof adjacent to and parallel to the perimeter of each of said islands, said recess being about 0.12 mm to about 1.6 mm in depth with the ratio of lateral dimension to depth of recess being about 5 50.

7. A process as defined in claim 6 wherein said metal is nickel.

* * * * *